US006474282B1

(12) United States Patent
Pryba et al.

(10) Patent No.: US 6,474,282 B1
(45) Date of Patent: Nov. 5, 2002

(54) FLAT ROCKER ARM HAVING A CLEVIS

(75) Inventors: Stanley J. Pryba; Scott P. Smith, both of Toledo, OH (US)

(73) Assignee: Toledo Technologies Inc., Perrysburg, OH (US)

( * ) Notice: Subject to any disclaimer, the term of this patent is extended or adjusted under 35 U.S.C. 154(b) by 0 days.

(21) Appl. No.: 09/916,167

(22) Filed: Jul. 26, 2001

(51) Int. Cl.[7] ..... F01L 1/18
(52) U.S. Cl. ..... 123/90.39; 123/90.4
(58) Field of Search ..... 123/90.4, 90.39, 123/90.41; 74/559; F01L 1/18

(56) References Cited

U.S. PATENT DOCUMENTS 1,449,611 A 3/1923 Konigslow
2,829,540 A 4/1958 Niemeyer ..... 74/569
4,674,453 A 6/1987 Dove, Jr.
5,038,726 A 8/1991 Pryba

*Primary Examiner*—Thomas Denion
*Assistant Examiner*—Sean O'Brien
(74) *Attorney, Agent, or Firm*—Rader, Fishman & Grauer PLLC

(57) ABSTRACT

The present invention is directed to a rocker arm having a pivoting clevis mounted to a second end of the rocker arm that engages a valve stem or a bridge that activates dual valves. The clevis has a substantially flat contacting surface and an internal recess created by two upwardly extending walls and an upwardly facing cam surface or receiving the second end of the rocker arm. The clevis is attached to the second end of the rocker arm by an attachment pin that extends through the upwardly extending walls of the clevis and through the second end of the rocker arm. The second end of the rocker arm has a downwardly extending portion that mates with the upwardly facing cam surface of the clevis to allow the clevis to pivot about the attachment pin.

24 Claims, 3 Drawing Sheets

FLAT ROCKER ARM HAVING A CLEVIS

FIELD OF THE INVENTION

The present invention relates to rocker arm assemblies for internal combustion engines and, in particular, to rocker arm assemblies with an improved mechanism for engaging a valve stem.

BACKGROUND OF THE INVENTION

Rocker arm assemblies are utilized in internal combustion engines for alternately actuating intake and exhaust valves. As an engine cam shaft rotates, a push rod is selectively actuated by cams located on the cam shaft. The push rods, in turn, direct an upward force on one end of a rocker arm to cause the rocker arm to pivot about a pivot point. As the rocker arm pivots, its opposite end generates a downward force to selectively open an engine valve. Thus, the rocker arm translates the motion of the cam shaft into the opening of the engine valves. Since the timing of the opening of the intake and exhaust valves is important to proper operation of an internal combustion engine, anything that interferes with the timing will detrimentally effect engine performance.

Typically, known rocker arms are integral, one-piece components having a first end, a,second end, and an intermediate portion for pivotally mounting the rocker arm. The first end of the rocker arm has a push rod engagement portion that engages with an upper end of a push rod. Typically, the push rod engagement portion is a downwardly facing recess which receives the upper end of the push rod. The second end of the rocker arm includes a contact surface that engages a valve stem. One known rocker arm uses a downwardly facing pad as a contact surface. Another known rocker arm uses a roller member positioned in a recess formed in the second end of the rocker arm as a contact surface.

However, prior art designs for engaging the valve stems are undesirable in that they are susceptible to scrubbing. Scrubbing is abrasion of the rocker arm and the valve stem due to friction. Scrubbing leads to unwanted physical deterioration of the rocker arm and the valve stem, which in turn leads to irregularity in the timing relationship between the cam shaft and the valves. Irregularity in the timing relationship increases engine noise and decreased engine operation efficiency.

Accordingly, there is a need to provide an improved, cost-effective rocker arm that minimizes or eliminates scrubbing, thereby prolonging operational life of the rocker arm and valve stem.

SUMMARY OF THE INVENTION

The present invention is directed to a rocker arm having a first end, a second end, and an intermediate portion. A pivoting clevis is pivotally mounted to the second end of the rocker arm for engaging a valve stem or a bridge that activates dual valves. The clevis has a flat contacting surface facing downward and an internal recess formed by two upwardly extending walls and an upwardly facing cam surface for receiving the second end of the rocker arm. A downwardly extending portion of the second end mates with the upwardly facing engagement surface of the clevis.

The clevis is attached to the second end of the rocker arm by an attachment pin that extends through the upwardly extending walls of the clevis and through the second end of the rocker arm such that the clevis selectively pivots about the attachment pin. The downwardly extending portion of the second end and the upwardly facing cam surface of the clevis maintain sliding contact throughout the motion of the rocker arm to provide pivoting action of the clevis. The pivot action of the clevis minimizes or eliminate scrubbing while maintaining contact with the valve stem or bridge.

DESCRIPTION OF THE PREFERRED EMBODIMENTS

Figure 1:
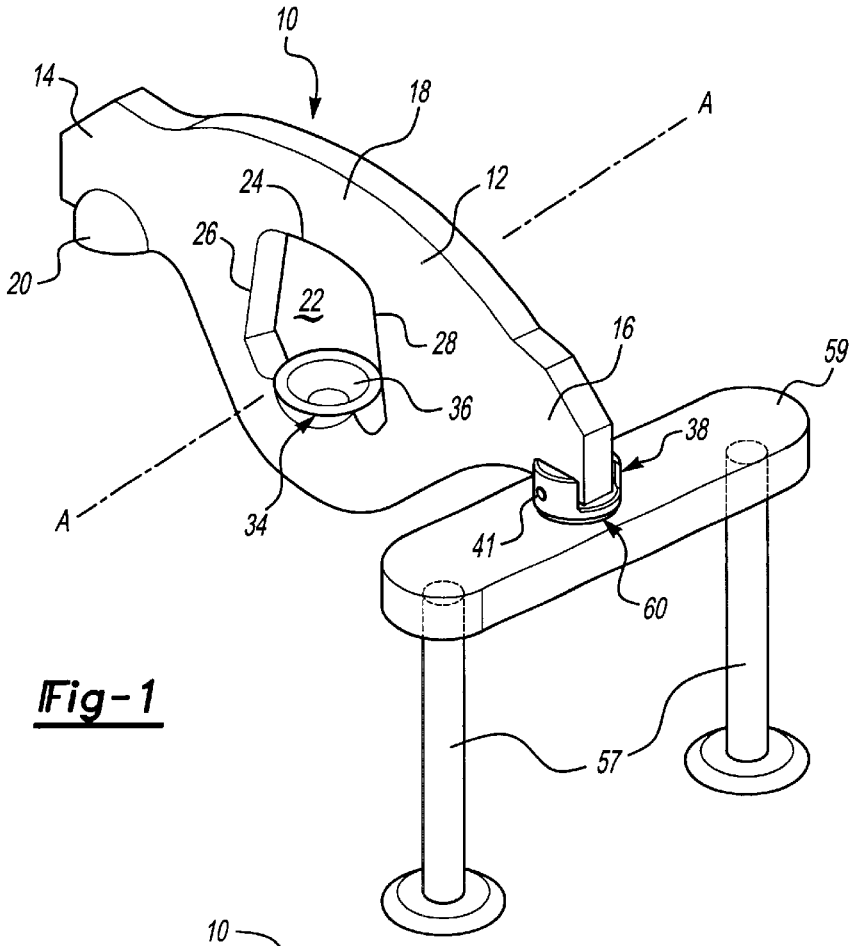
FIG. 1 is perspective view of a rocker arm assembly in accordance with the present invention.
Figure 2:
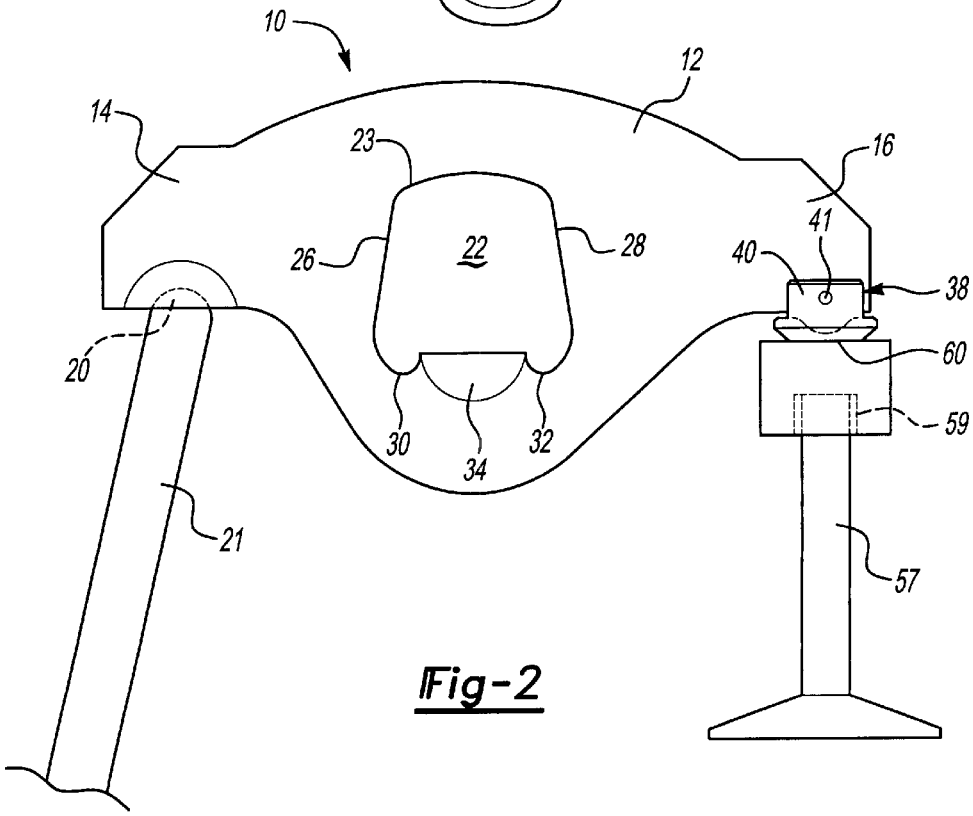
FIG. 2 is a side view of the rocker arm assembly depicted in FIG. 1.
Figure 3:
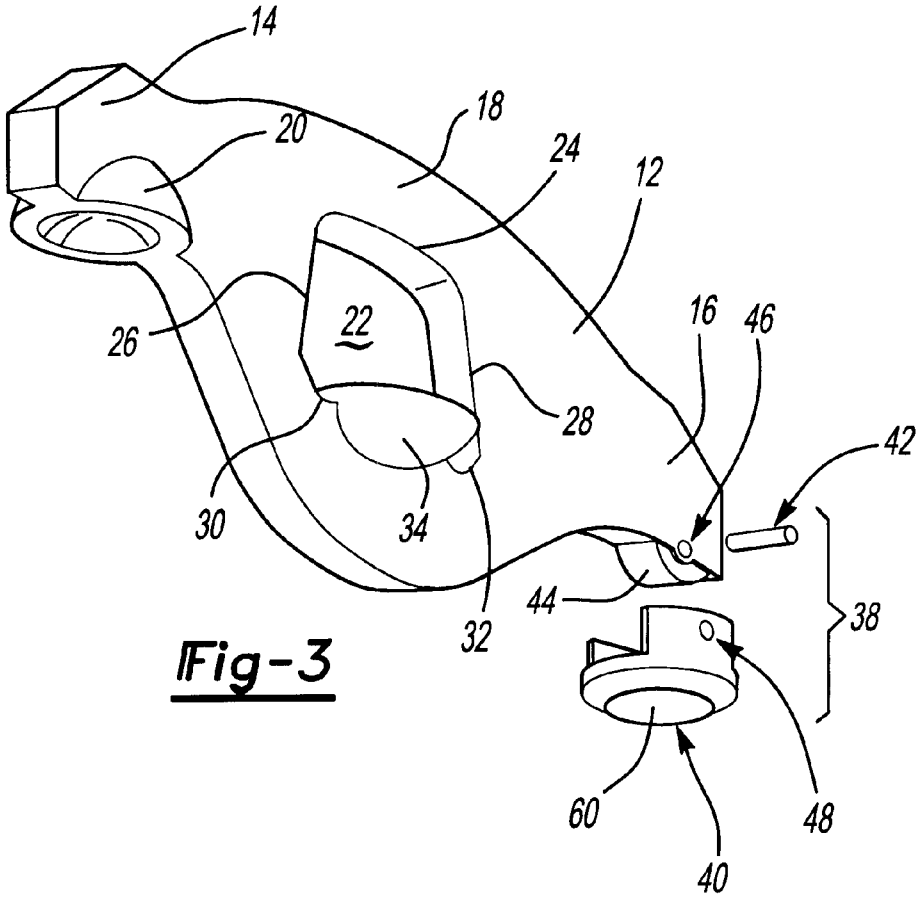
FIG. 3 is a partially exploded view of a second end of the rocker arm assembly.

Referring to the FIGS. 1–3, a rocker arm assembly 10 in accordance with the present invention is shown. Rocker arm assembly 10 includes a one-piece rocker arm 12 having a first end 14, a second end 16 and an intermediate portion 18.

First end 14 includes a push rod engaging portion 20 that cooperates with a push rod 21. Engaging portion 20 is a structurally-integral, downwardly facing socket 23, which receives an upper end of the push rod. Socket 23 has a generally semispherical shape that matingly receives a correspondingly shaped push rod end. However, it is understood that any known device which engages a push rod may be used.

Intermediate portion 18 includes a joint 19 that allows pivoting action of the rocker arm 12 about an axis A—A transverse to the axis of the rocker arm 12. Intermediate portion 18 includes a central opening 22 which is generally trapezoidal shape. In one preferred embodiment, opening 22 includes a rounded upper edge 24, side edges 26 and 28 that converge in an upward direction, and bottom edge portions 30 and 32. However, it is understood that opening 22 may be formed in any suitable shape. A structurally-integral, upwardly facing pivot ball socket 34 is formed in the intermediate portion 18 between the bottom edge portions 30 and 32. Pivot ball socket 34 is a generally semispherical recess 36.

Pivot ball socket 34 is preferred because socket 34 is integral to rocker arm 12 and thus requires no assembly of rocker arm 12 and socket 34. Further, because of its integral nature, the rocker arm 12 will always have a correctly assembled socket 34. Further, socket 34 will not come loose from the rocker arm 12 during operation. Assembly problems and operational loosening are deficiencies found in the prior art which are overcome with pivot ball socket 34 on rocker 12.

Although the pivot ball socket 34 in opening 22 is the preferred method of pivotally mounting the rocker arm 12, other suitable pivoting joints known in the art may be used in intermediate portion 18 to pivotally mount rocker arm 12.

Second end 16 of rocker arm 12 engages a valve stem 57 or bridge 59, to be explained below in further detail. In accordance with a feature of the present invention, second end 16 has a clevis assembly 38 that includes a downwardly extending portion 44 and a clevis 40 mounted thereto to provide an improved engagement surface and reduced scrubbing. Portion 44 has an arcuate or convex shaped surface.

Figure 4:
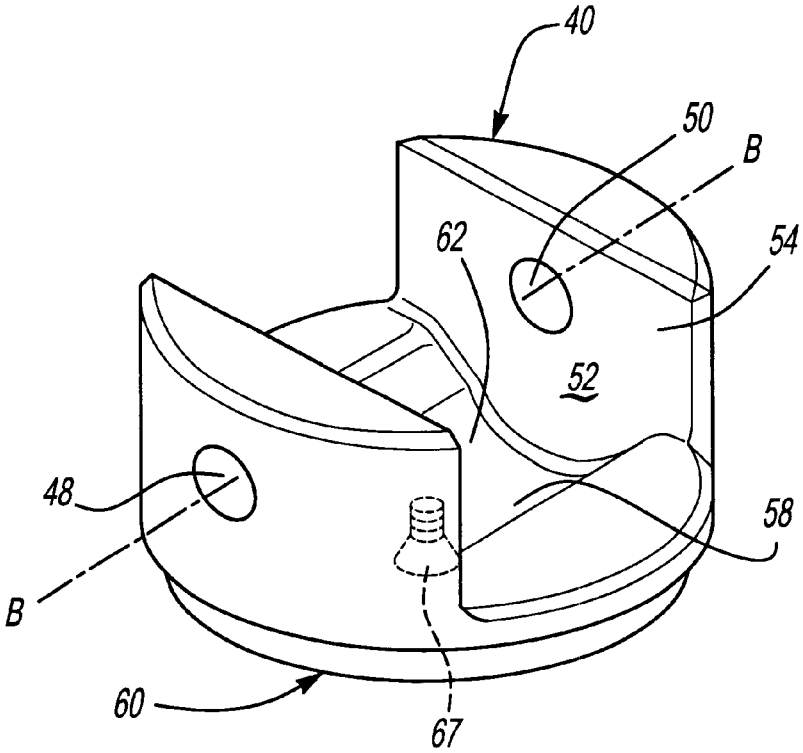
FIG. 4 is a perspective view of a clevis in accordance with the present invention.
Figure 5:
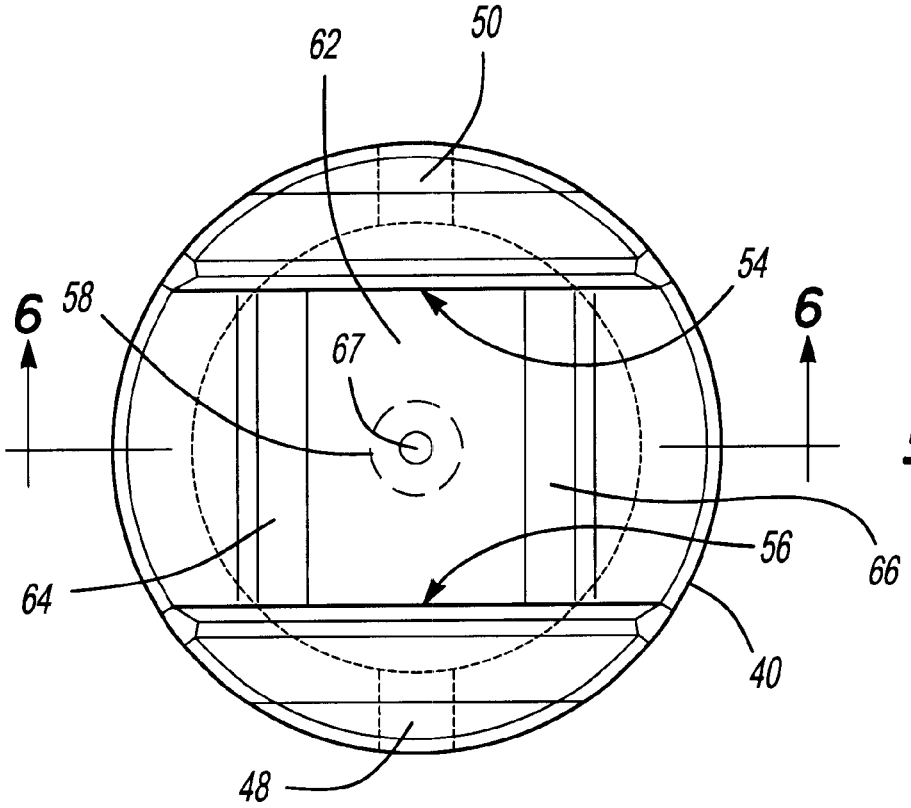
FIG. 5 is a top view of the clevis depicted in FIG. 4.
Figure 6:
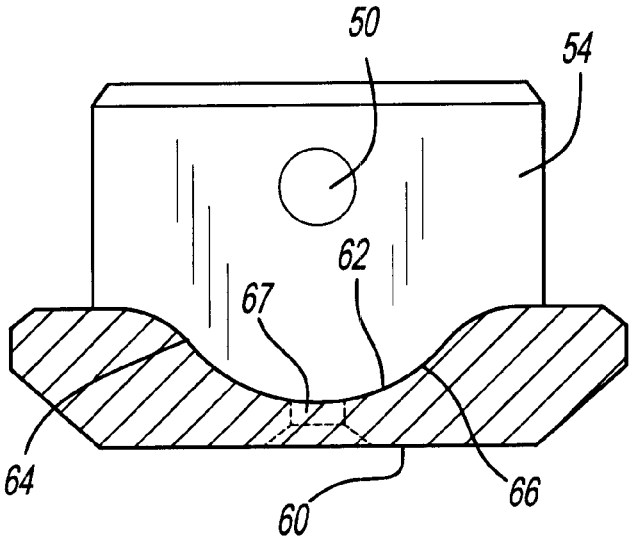
FIG. 6 is a sectional view of the clevis, taken along line 6—6 in FIG. 5.

As shown in FIGS. 4–6, clevis 40 includes two upwardly extending walls 54, 56 that are connected by an upwardly facing cam surface 58 thereby forming a central recess 52 therein. Walls 54, 56 are parallel and spaced apart such that the distance between walls 54, 56 is slightly more than the thickness of second end 16, so that the clevis 40 fits on the second end 16. Clevis 40 further includes a contacting surface 60 which engages the valve stem 57 or dual valves by way of a bridge 59, as best seen in FIG. 1. Contacting surface 60 is generally flat.

Upwardly facing cam surface 58 has a concave shape and includes a middle portion 62 surrounded by first and second engagement portions 64 and 66, respectfully. Engagement portions 64, 66 are arcuate and have substantially the same radius. Middle portion 62 is also arcuate and has a radius which is different from the radius of the engagement portions 64, 66. The combination of middle portion 62 and engagement portions 64, 66 on cam surface 58 helps to seat downwardly extending portion 44 of second end 16 in clevis 40 while providing smooth pivotal motion of clevis 40. Cam surface 58 further preferably includes at least one lubrication hole 67 to provide oil or other suitable lubrication to mating valve stem 57 or bridge 59. Lubrication hole 67 is preferably chamfered or countersunk from contacting surface 60.

Clevis 40 is pivotally mounted to second end 16 by an attachment pin 42. Accordingly, second end 16 is provided with a first mounting hole 46 that extends transversely through second end 16 adjacent to downwardly extending portion 44. Walls 54 are each provided with corresponding second mounting holes 48, 50. Clevis 40 is mounted on second end 16, with downwardly extending portion 44 positioned with central recess 52 such that second mounting holes 48, 50 are aligned with first mounting hole 46. An attachment pin 42 is inserted through the aligned first and second mounting holes such that clevis 40 pivots about axis B—B.

Even though attachment pin 42 attaches clevis 40 to second end 16, attachment pin 42 is preferably not load bearing. By making attachment pin 42 non-load bearing, the cost of a pin with the increase strength to bear the loads created by the rocker arm can be avoided. A non-load bearing attachment pin 42 is possible because of sliding interacting of portion 44 and engagement portion 64 and 66. The load created by the engine is passed through rocker 12 to clevis 40 by the contact of portion 44 to engagement portions 64 and 66. From there the load is passed from contacting surface 38 to the valve stem or bridge. Thus, the preferred purpose of attachment pin 42 is to hold clevis 40 in a position so that portion 44 is in sliding contact with engagement surfaces 64 and 68.

Alternately, attachment pin 42 is partially load bearing. By making attachment pin 42 partially load bearing, the tolerances of the rocker arm assembly can be loosened. The load created by the engine is passed through rocker 12 to clevis 40 by the contact of portion 44 to engagement portions 64 and 66 and through attachment pin 42. This insures that clevis 40 will pivot freely. From the clevis, the load is passed through contacting surface 38 to the valve stem or bridge.

First mounting hole 46 is preferably slightly larger than attachment pin 42 so that pin 42 is clearance fit in hole 46. Second mounting holes 48, 50 are preferably sized such that pin 42 tightly fits into these holes. Alternately, an adhesive or other means may be used to attach attachment pin 42 to second mounting holes 48, 50.

Blanks of the clevis may be manufactured by stamping, forging or other methods known in the art so as to form the two walls and the cam surface which surround three sides of the central recess. In the walls of the clevis, second mounting holes are drilled or otherwise created by methods known in the art. Additional steps may be utilized to provide a finished middle portion and engagement surfaces of the cam surface. After the second mounting holes are made in the clevis, to attach the clevis to the rocker arm, the second mounting holes are aligned with the first mounting hole of the rocker arm and a pin is inserted therethrough.

Although the clevis 40 and attachment pin 42 combination shown is preferred, any suitable method of pivotally attaching clevis 40 to second end 16 of rocker arm 12 may be used.

In operation, downwardly extending portion 44 of second end 16 and engagement portions 64, 66 maintain sliding engagement throughout the motion of rocker arm 12. The sliding engagement allows for a pivoting motion of the clevis 40 about the pin 42. Because the portion 44 does not contact middle portion 62, friction, which retards the pivoting motion of clevis 40, is reduced so that clevis 40 can pivot even transferring load from the rocker arm to valve stem 57 or bridge 59.

The pivoting attachment of clevis 40 to rocker arm 12 minimizes or eliminates scrubbing of rocker arm 10 and valve stem 57 (or bridge 59) that is normally associated with a fixed, non-pivoting contacting surface that engages a valve stem. In contrast to a non-pivoting contacting surface, in the present invention, contacting surface 60 of clevis 40 remains in one location on valve stem 57 or bridge 59 throughout the entire motion of rocker arm 12.

The prevention of deterioration of rocker arm 12 and the valve stem 57 (or bridge 59) increases the duration of time where the timing relationship between the cam shaft and the cylinders is maintained, thus, increasing the efficiency of the engine and reducing engine noise.

While the invention has been specifically described in connection with certain specific embodiments thereof, it is to be understood that this is by way of illustration and not of limitation, and the scope of the appended claims should be construed as broadly as the prior art will permit.

We claim:

1. A rocker arm assembly for an internal combustion engine with a push rod and at least one valve stem, comprising:

a first end having a push rod engagement portion adapted to receive the push rod;

an intermediate portion; and a second end which cooperates with at least one valve stem to provide reciprocating movement to at least one valve stem, wherein a clevis is pivotally attached to said second end and has a contacting surface that operationally engages at least one valve stem.

2. The rocker arm assembly of claim 1, wherein said second end further includes a downwardly extending portion which engages an internal surface of said clevis.

3. The rocker arm assembly of claim 2, wherein said downwardly extending portion has a convex shape.

4. The rocker arm assembly of claim 2 wherein said clevis includes upwardly extending walls that partially surround said downwardly extending portion of said second end, said upwardly extending walls of said clevis pivotally connect to said second end.

5. The rocker arm assembly of claim 4, wherein said internal surface is a cam surface that connects said upwardly extending walls to form an internal recess.

6. The rocker arm assembly of claim 5, wherein said cam surface has a concave shape.

7. The rocker arm assembly of claim 6, wherein said cam surface includes two engagement portions and a middle portion therebetween.

8. The rocker arm assembly of claim 7, wherein said two engagement portions are arcuate with a first predetermined radius and said middle portion is arcuate with a second predetermined radius.

9. The rocker arm assembly of claim 8, wherein said first predetermined radius is different from said second predetermined radius so that said downwardly extending portion selectively, slidingly engages said two engagement portions.

10. The rocker arm assembly of claim 4, wherein said second end further includes a first mounting hole and each of said upwardly extending walls further include a corresponding second mounting hole, wherein said first and second mounting holes receive an attachment pin when said mounting holes are aligned so as to attach said clevis to said second end.

11. The rocker arm assembly of claim 10, wherein said internal surface is a concave surface cam that connects said upwardly extending walls to form an internal recess.

12. The rocker arm of claim 11, wherein said cam surface includes two arcuate engagement surfaces with a first predetermined radius and an arcuate middle portion with a second predetermined radius.

13. The rocker arm of claim 12, wherein said first predetermined radius is different from said second predetermined radius so that said downwardly extending portion selectively, slidingly engages said two engagement portions.

14. The rocker arm of claim 10, wherein said first and second mounting holes are located such that when said mounting holes are aligned to pivotally attach said clevis to said second end, said downward extending portion slidably engages said two engagement portions so that said attachment pin is non-load bearing.

15. The rocker arm of claim 10, wherein said first and second mounting holes are located such that when said mounting holes are aligned to pivotally attach said clevis to said second end, said downward extending portion slidably engages said two engagement portions so that said attachment pin is partially load bearing.

16. The rocker arm assembly of claim 1, wherein said push rod engagement portion of said first end includes a downwardly facing socket.

17. The rocker arm assembly of claim 1, wherein said contacting surface further includes at least one lubrication hole extending therethrough.

18. The rocker arm assembly of claim 1, wherein said intermediate portion further includes an opening that includes a pivot ball socket.

19. The rocker arm assembly of claim 18, wherein said pivot ball socket is positioned in a lower portion of said opening such that said pivot ball socket is upwardly facing.

20. The rocker arm assembly of claim 18, wherein said pivot ball socket is integral with said intermediate portion.

21. The rocker arm assembly of claim 1, wherein said first end, said intermediate portion, and said second end are structurally integral.

22. The rocker arm assembly of claim 1, wherein said contacting surface operationally engages dual valve stems via a bridge.

23. A rocker arm assembly for an internal combustion engine including a push rod and at least one valve stem comprising:

a first end having a downward facing socket adapted to receive the push rod;

an intermediate portion having a pivot ball socket;

a second end having a convex, downwardly extending portion and a first mounting hole therethrough, wherein said second end cooperates with at least one valve stem to provide reciprocating movement to at least one valve stem; and a clevis having two upwardly extending walls, each with second mounting holes therethrough, and a concave cam surface connecting said two upwardly extending walls, wherein said clevis is pivotally attached to said second end when said first and second mounting holes are aligned and an attachment pin is positioned therein such that said clevis is pivotable about said pin.

24. A clevis which pivotally attaches to a rocker arm assembly comprising:

a contacting surface;

two upwardly extending walls, each with a mounting hole therethrough; and a cam surface which connects said two upwardly extending wall so as to form an internal recess, wherein said cam surface includes two engagement surfaces and a middle portion therebetween such that said two engagement surfaces selectively, slidably engage a downwardly extending portion of the rocker arm assembly, and such that when the clevis is pivotally attached to the rocker arm assembly, reciprocal motion of the rocker arm assembly will prevent scrubbing where said contacting surface operationally engages at least one valve stem.

* * * * *